United States Patent [19]

Newman

[11] 4,276,985

[45] Jul. 7, 1981

[54] TRUCK MOUNTED RAILROAD CRANE

[76] Inventor: Timothy L. Newman, 1810 Craig Rd., St. Louis, Mo. 63141

[21] Appl. No.: 76,013

[22] Filed: Sep. 17, 1979

[51] Int. Cl.[3] ..... B66C 23/62

[52] U.S. Cl. ..... 212/177; 212/189

[58] Field of Search ..... 212/177, 187, 189, 266; 280/763–766

[56] References Cited

U.S. PATENT DOCUMENTS

| | | | |
|---|---|---|---|
| 2,975,910 | 3/1961 | Conrad | 212/188 |
| 3,338,426 | 8/1967 | Grove | 212/189 |
| 4,214,665 | 7/1980 | Newman | 212/177 |

*Primary Examiner*—Robert G. Sheridan

*Attorney, Agent, or Firm*—Michael Kovac

[57] ABSTRACT

Apparatus for substantially increasing the load lifting capacity of mobile vehicles, such as truck mounted railroad cranes and the like, without a proportionate increase in the weight thereof, including stabilizing outrigger assemblies integrally supported by and weight distributed through the main bed frame, an improved main bed frame design, and an improved crane boom superstructure.

9 Claims, 17 Drawing Figures

TRUCK MOUNTED RAILROAD CRANE

SUMMARY OF THE INVENTION

The present invention is directed to mobile vehicles in general, and more specifically, to truck mounted railroad cranes which are convertible highway/railway vehicles capable of highway travel on a truck chassis, as well as being convertible for travel on train rails through extensible front and rear train rail gear, which guide the vehicle on train tracks, while allowing the rubber wheels of the vehicle to move the vehicle to the desired location. Such vehicles are principally used for train derailments, although they are useful for other train and rail construction and maintenance operation.

At the site of a train derailment, the truck mounted railroad crane, which has previously been driven as a truck over highways and then positioned on or adjacent tracks leading to the train derailment, is ready to reposition de-railed train cars back onto tracks from which they have become derailed. This is achieved through the swiveling crane boom also mounted on the truck chassis. The operator of the truck mounted railroad crane positions himself in the crane cab to operate the crane controls that raise, lower and swing the crane boom for repositioning the de-railed railcar back on train rails.

Truck mounted railroad cranes are thus versatile pieces of equipment that require both highway and railway travel, as well as operation and control of crane booms. As will also be appreciated, such vehicles must withstand rigorous conditions encountered in transporting same and in operating the crane.

At the present time, the biggest problem with truck mounted railroad cranes is that the total working weight which is necessary to lift de-railed train cars presents difficulties in transporting such vehicles over highways since the machine weight exceeds highway load restrictions. As a result, current manufacturers have had to compromise the design of the machine with weight restrictions. Some manufacturers have even gone so far as to make some of the components removable, so they could be separately transported.

What current manufacturers have not effectively done is to design truck mounted railroad cranes to substantially increase their load lifting capabilities while meeting highway load limit restrictions. This has been achieved by the present invention through the coordinated design of outrigger assemblies, main bed frame and crane boom superstructure.

As is well known, outrigger assemblies are used to provide stability and prevent tipping of the crane during use. Normally, the outrigger extends outwardly from the vehicle and includes downwardly projecting feet for engaging the ground to provide lateral support for the vehicle. While there are many different outrigger designs, as shown, for example, in U.S. Pat. Nos. 2,209,392; 3,064,825; and 4,027,801, none of them appear to have included stabilizing outrigger assemblies integrally supported by and weight distributed through the main bed frame to offset the forces encountered when lifting large loads.

With regard to the main bed frame, and the crane booms, it has been found that the size and weight of truck mounted railroad cranes do not offset the torsional and bending forces to which crane booms and the supporting frame is subjected. It has been found, for example, that the supporting frame for the crane itself can be twisted or bent when re-positioning a de-railed car through the crane boom.

Similarly, is will be appreciated that crane booms are subjected to extremely heavy loads and torsional stresses in serving as the main structural member for raising, lowering and swinging rail cars to the desired position. Most of the cranes presently used with truck mounted railroad cranes include an open network of overlapping crossbar elements such as shown in U.S. Pat. Nos. 2,975,910 and 3,306,470. With some frequency, crane booms of this design are not able to withstand the heavy loads and stresses to which they are subjected, thus causing the crane boom to become twisted or bent, and requiring repair thereof. Where twisting or bending occurs, it normally takes place in a particular area of the crane boom; however, the design of most crane booms requires the entire boom to be returned to the repair shop for maintenance and repair.

Accordingly, it is the principal object of the present invention to provide a mobile vehicle in the form of a truck mounted railroad crane or the like which has substantially increased load lifting capabilities while meeting highway load limit restrictions.

More particularly, it is an object of the present invention to provide the aforementioned vehicles with stabilizing outrigger apparatus that is integrally supported by and weight distributed through the main bed frame.

Another object of the present invention is to provide a new and improved main bed frame for the aforementioned vehicles that eliminates twisting or bending of the main bed frame when the crane is operated to lift heavy objects, such as de-railed train cars.

Still another object is to provide a structurally interconnected crane boom that withstands heavy loads and stresses while facilitating repair or replacement of the entire boom section.

These and other objects and advantages will become more apparent from the ensuing description.

DESCRIPTION OF THE PREFERRED EMBODIMENTS

Figure 1:
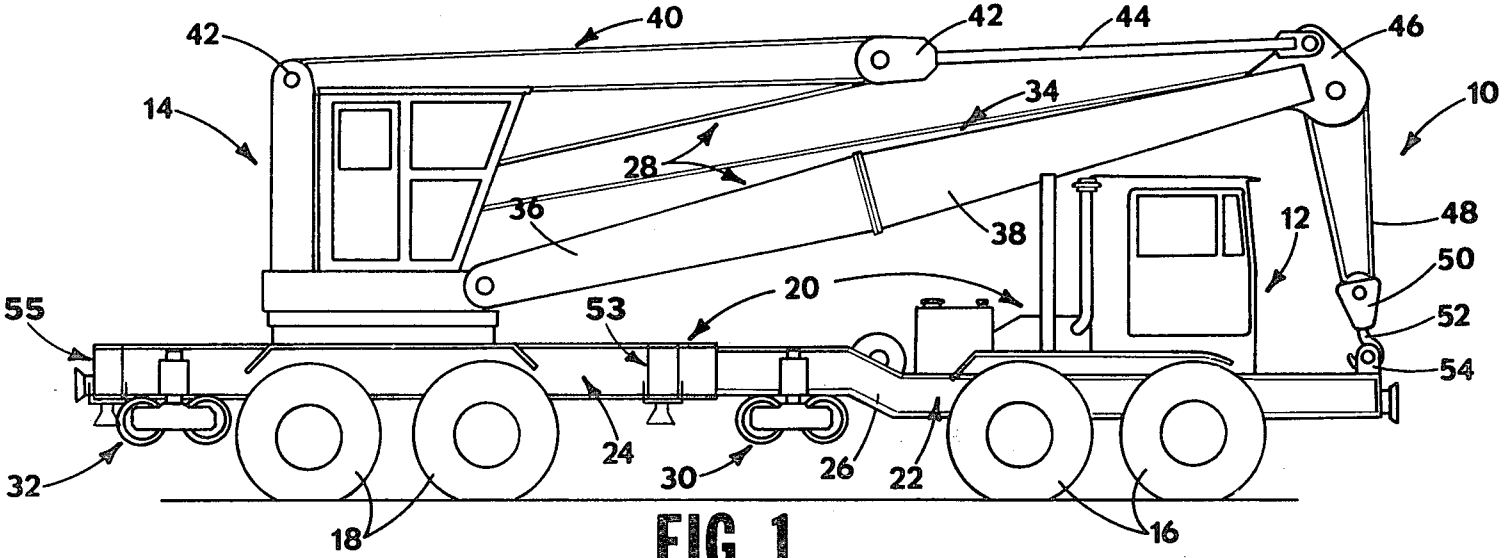
FIG. 1 is a side elevational view of a truck mounted railroad crane which is constructed in accordance with the teachings of the present invention.
Figure 2:
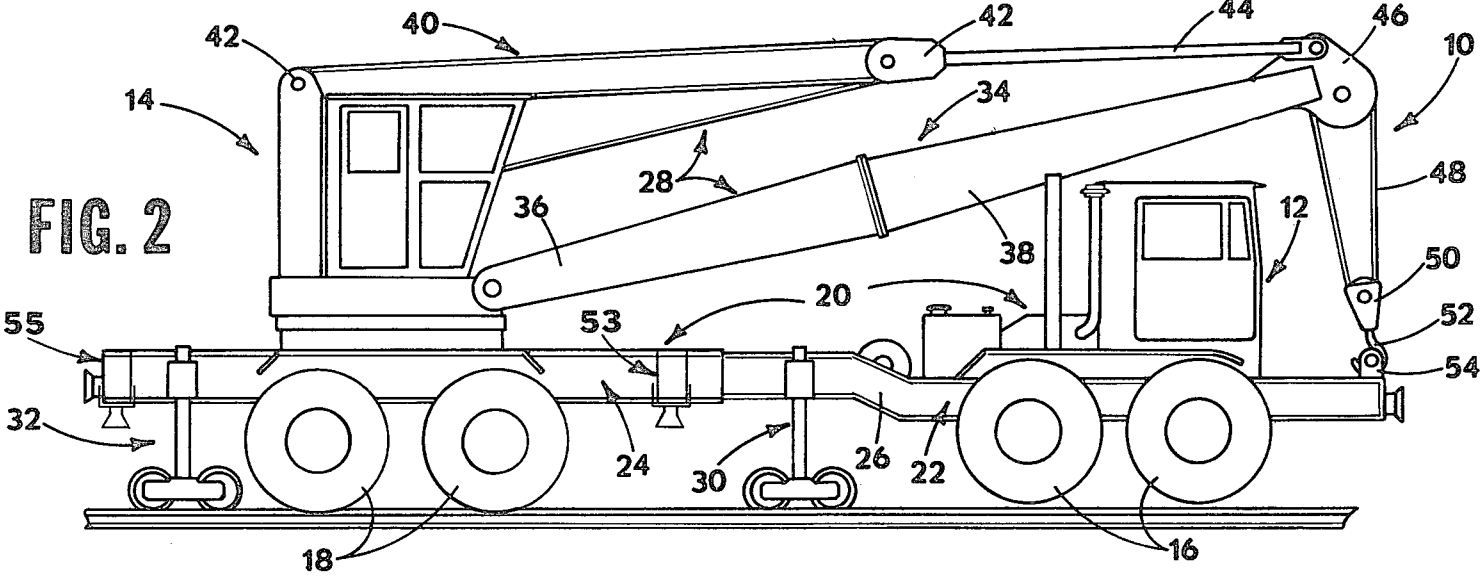
FIG. 2 is a side elevational view, similar to FIG. 1, but showing the truck mounted railroad crane convertible for travel on train rails.

FIGS. 1 and 2 of the drawings show my preferred design of truck mounted railroad crane 10 which includes a truck cab 12 at the front end and a crane cab 14 at the rear end. The truck cab 12 is mounted over the front pneumatic rubber tires 16 while the crane cab 14 is mounted over the rear pneumatic rubber tires 18. The truck cab 12 and crane cab 14 are interconnected through the vehicle frame 20 that includes a truck chassis frame 22 and crane bed frame 24. It will be seen that the truck chassis frame 22 is mounted lower than crane bed frame 24 through the angular interconnecting frame structure 26. There are several reasons for this including maintaining the crane boom superstructure 28 at the lowest possible height when traveling over highways, as shown in FIG. 1, while enabling the truck cab 12, frame 22 and tires 16 to be lifted off the railroad tracks, as shown in FIG. 2, to allow transporting of the truck mounted railroad crane 10 to the desired location over railroad tracks.

This lifting of the truck cab 12, frame 22 and tires 16 at the front end of the truck mounted railroad crane 10 is achieved by the front and rear train gear 30, 32 that are mounted on the crane bed frame. As seen in FIG. 1, the front and rear train rail gear 30, 32 respectively are maintained in a retracted position to allow the front and rear pneumatic rubber tires 16, 19 respectively to move the truck mounted railroad crane 10 over highways. However, when the desired train rail location has been reached, the truck mounted railroad crane 10 is driven into a straddle position over train rails, and the front and rear train rail gears 30, 32 respectively are lowered or extended to raise the truck cab 12, truck chassis frame 22 and front pneumatic rubber tires 16 off of the railroad tracks. This enables the front and rear train rail gears 30, 32 respectively to guide the truck mounted railroad crane 10 over train rails, while allowing inside pairs of wheels (not shown) of the rear pneumatic rubber tires 18 to rest upon and engage the train rails. In this way, the truck mounted railroad crane 12 is transported over train rails by the driven rear pneumatic rubber tires 18 of the truck mounted railroad crane 10. When the truck mounted railroad crane reaches the desired location, such as a train derailment, train rail construction, train rail maintenance operation or the like, the crane boom superstructure 28 may then be put into operation to raise, lower and swing train cars and the like, as may be desired, The crane boom superstructure 28 includes a boom 34 that is hingedly mounted to the crane cab 14 for raising or lowering of the boom 34, as well as for swiveling or rotational movement of the crane cab 14 and associated boom 34 relative to the crane bed frame 24. The boom 34 comprises two sections, an inboard section 36 and an outboard section 38. The inboard section 36 is pivotally or hingedly attached to the crane cab 14 while the outboard section 38 is supported and its angular position controlled by means of the hoisting cables 14 reeved through suitable hoisting cable sheeves 42 and the connecting link 44 that extends between the outermost sheeve 42 and the fixed block sheeve 46 mounted at the free end of the outboard section 38. The fixed block sheeve 46 threadably carries a lift cable 48 which is also threaded over a load engaging block 50 that includes a hook 52. When not in use, the hook 52 is restrained by the shaft block 54 mounted at the front of the truck chassis frame 22, as seen in FIGS. 1 and 2.

It will be noted that the truck mounted railroad crane 10 further includes front and rear stabilizing apparatus 53, 55 respectively which are designed to extend and engage the ground, as is well known, when the crane boom superstructure 28 is operated, in order to prevent tipping of the crane during use.

With the above general description of the truck mounted railroad crane 10, specific descriptions will now be given for the main bed frame 24, the crane boom 34, and the front and rear stabilizing outrigger apparatus 53, 55.

Main Bed Frame

The main bed frame 24 incorporates a structural configuration of components which prevents bending or twisting of the main bed frame 24 when the crane cab 14 and crane boom superstructure 28 are used to raise, lower and swing rail cars and the like. This is very important since a twisted or bent supporting frame can render the truck mounted railroad crane 10 inoperative, requiring extensive costs and time to repair. Size and weight alone are not determinative, but rather it has been found that a structural configuration of the components used in the main bed frame 24 can produce a favorable result over long term use.

Figure 3:
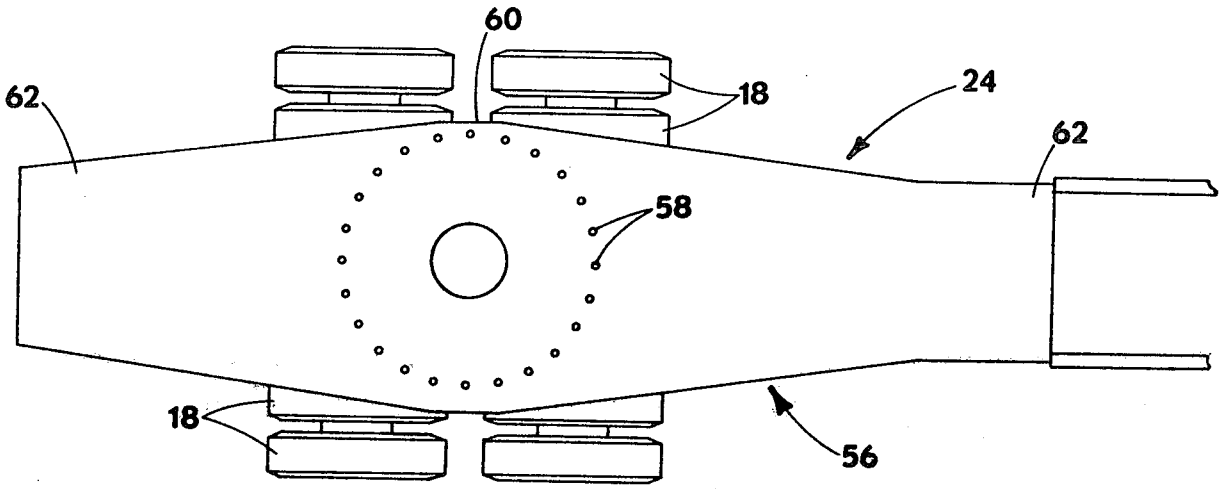
FIG. 3 is a top plan view of the main bed frame of the truck mounted railroad crane.
Figure 4:
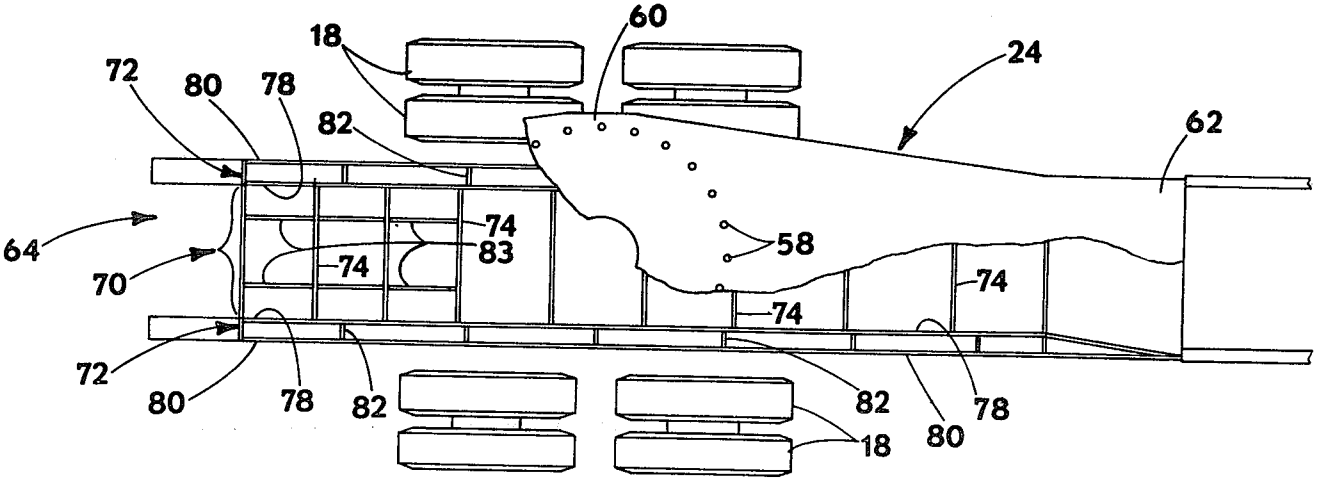
FIG. 4 is a fragmentary top plan view of the main bed frame of the truck mounted railroad crane, showing some of the structural configurations thereof.

The main bed frame 24 includes an upper main bearing plate 56 upon which the crane cab 14 and crane boom superstructure are mounted in the vicinity of the circular arranged crane cab mounting holes 58 shown in FIGS. 3–4. As best seen in FIGS. 3–4, the upper main bearing plate 56 is widest along the central portion 60 thereof and tapers inwardly on each side of the central portion 58 to the opposite free ends thereof. The greatest stress and load for the upper main bearing plate 56 occurs when the crane boom superstructure 28 is generally parallel with the axles of the rear pneumatic rubber tires 18, and thus the upper main bearing plate 56 is widest in that area. From that position to a position where the crane boom superstructure 28 extends substantially normal to the axles of the rear pneumatic rubber tires 18, the upper main bearing plate 56 provides stress and load support to the crane boom superstructure by tapering inwardly to the opposite free ends 62 thereof, where the under supporting structure 65 for the upper main bearing plate 56 generally underlies and supports same. Accordingly, tie bar supports 66 extend between the under surface of the upper main bearing plate 56 and the under supporting structure 64 on each side thereof, as best seen in FIGS. 5–6, to structurally interconnect the overextended portions of the upper main bearing plate 56 to the under supporting structure 64 of the main bed frame 24, for additional stress and load support to the crane boom superstructure 28.

Figure 5:
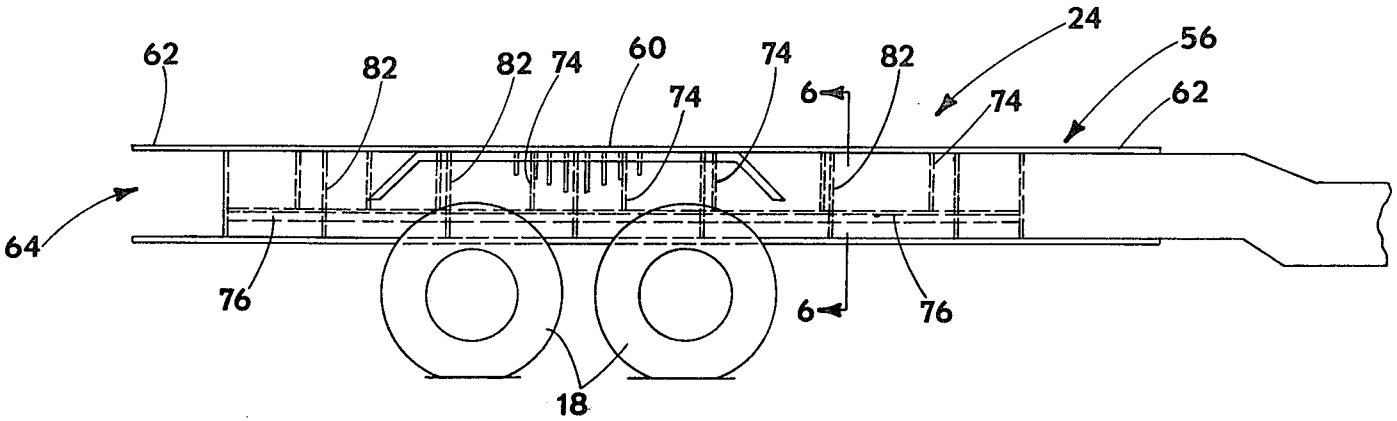
FIG. 5 is a fragmentary side elevational view of the main bed frame with some of the structural components thereof being illustrated.
Figure 6:
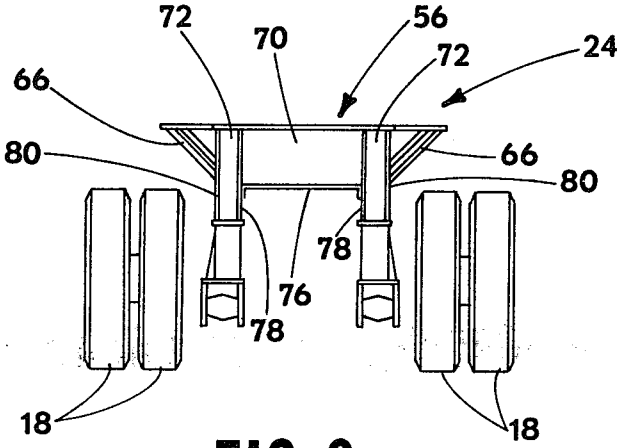
FIG. 6 is an end elevational view of the main bed frame, as viewed along lines 5—5 of FIG. 5.

Referring now to the under supporting structure 64 for the upper main bearing plate 56, it will be seen from FIGS. 4–6, that the under supporting structure 64 includes an inner supporting frame section 70 separating a pair of outer supporting frame sections 72, 72, all of which underlie and support the upper main bearing plate 56 for substantially the entire length thereof, but not the entire width thereof, as explained above.

The inner support frame section 70 includes a plurality of vertically disposed brace plates 74 supported by a lower frame bearing plate 76. Connecting adjacent brace plates 74 to each other are stronger supports 83 which add structural support to the rear area of the frame. The pair of outer supporting frame sections 72, 72 include inner and outer vertically disposed side walls 78, 80 respectively which extend substantially normal to and engage the vertically disposed brace plates 74 of the inner supporting frame section 70. Both of said outer supporting frame sections 72, 72 also include vertically disposed brace elements 82 which extend substantially normal to and between the inner and outer vertically disposed side walls 78, 80 respectively of the outer supporting frame sections 72, 72. The axles of the rear pneumatic tires 18 support the outer supporting frame sections 72, 72 as seen in FIG. 6, and thus undergird and support the under supporting structure 64 and upper main bearing plate 56 of the main bed frame 24.

In order to maximize structural support for stress and loads to the main bed frame 24 by the crane boom superstructure 28, the vertically disposed brace plates 74 of the inner supporting frame section 70 are longitudinally offset relative to the vertically disposed brace plates 82 of the outer supporting frame sections 72, 72.

Crane Boom

Both the inboard section 36 and the outboard section 38 are shown as being provided with an enclosed exterior wall construction that is of generally rectangular cross sectional configuration. The enclosed exterior wall construction of the inboard section 36 defined by upper wall portion 90, bottom wall portion 92, and opposite side wall portions 94, 96. The enclosed exterior wall construction of the outboard section 38 is defined by upper wall portion 100, bottom wall portion 102, and opposite side wall portions 104, 106.

Figure 7:
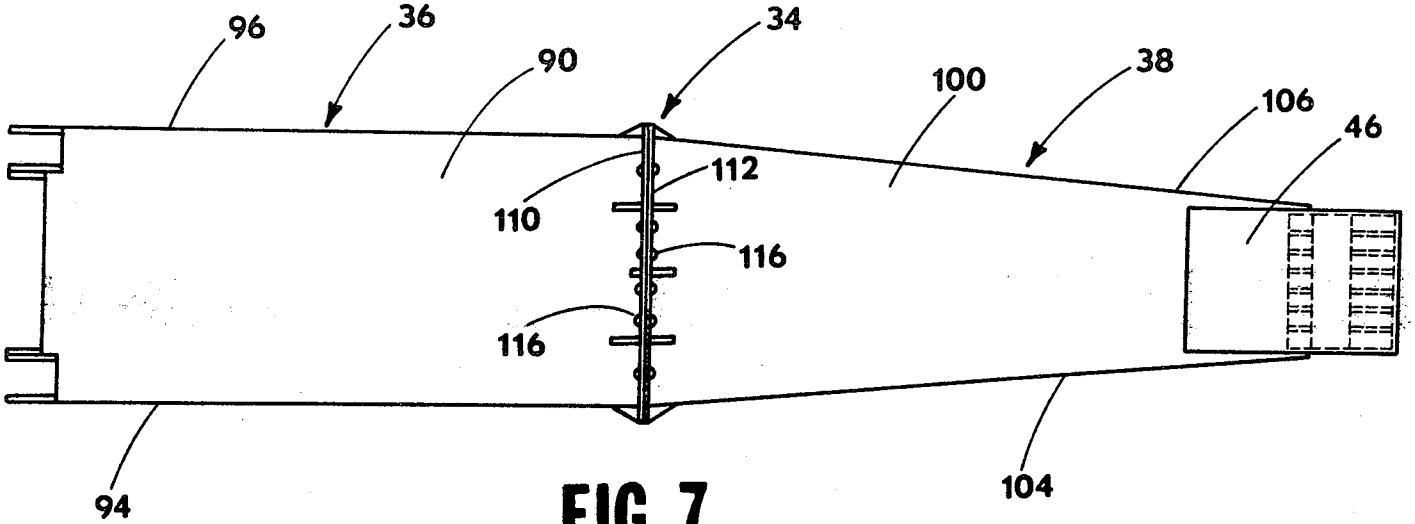
FIG. 7 is a top plan view of the crane boom section of the herein described invention.
Figure 10C:
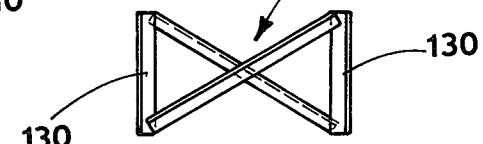
FIGS. 10A, 10B, 10C, 10D and 10E are end elevational views of the inner and connecting components of the crane boom section.
Figure 10D:
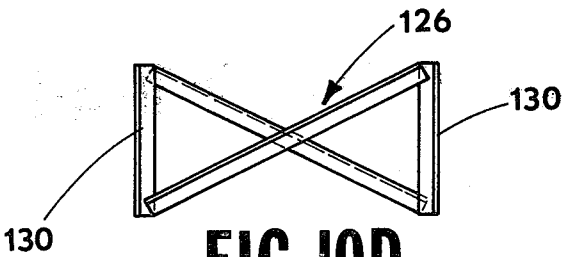
Figure 10E:
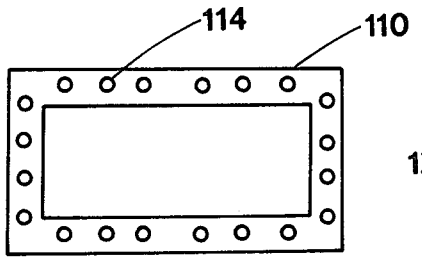
Figure 10A:
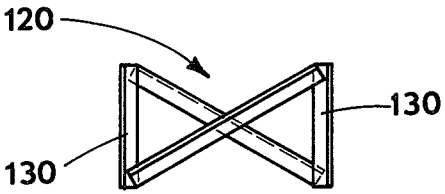
Figure 10B:
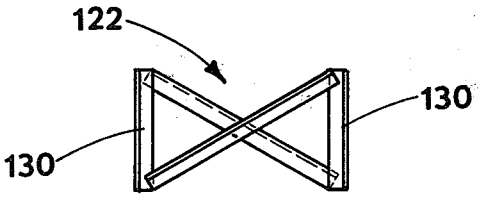

The inboard section 36 and outboard section 38 are releasably interconnected at one end thereof by way of the complementary flange plates 110, 112 which are welded to the enclosed exterior wall of the inboard section 36 and outboard section 38. The flange plates 110, 112 are identical in size and shape, and a representative illustration is shown in FIG. 10E of the drawings. It will be seen in FIG. 10E that spaced openings 114 are formed in the flange plates 110, 112 for receiving suitable fastening means, such as the complementary nut and bolt means 116 shown in FIGS. 7–8.

Thus in the event of twisting or bending the inboard section 36 or outboard section 38, they may be releasably unfastened relative to one another to permit the twisted of bent section to be returned to the repair shop for maintenance or repair thereof.

In order to prevent or restrain twisting or bending of the inboard section 36 and outboard section 38, the present invention incorporates several important features, as will now be discussed.

Figure 9:
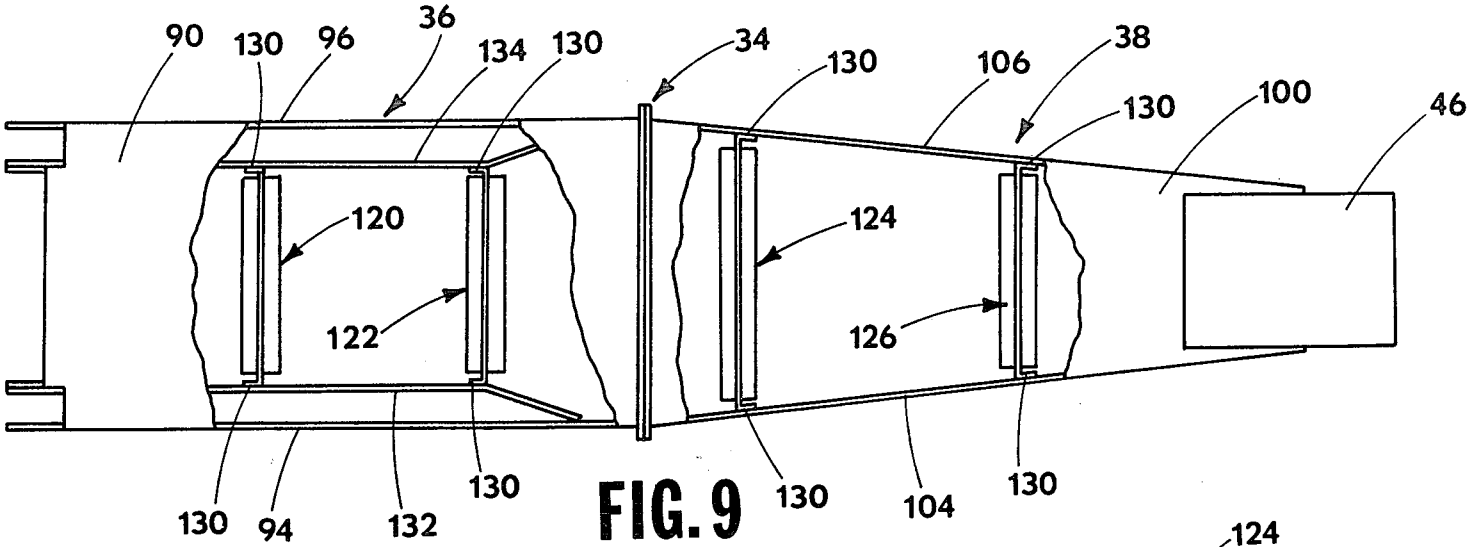
FIG. 9 is a fragmentary top plan view of the crane boom section showing the inner components thereof.

In conjunction with the enclosed exterior wall constructions of both the inboard section 36 and the outboard section 38 of the boom 34, it will be seen in FIG. 9 that each boom section is provided with spaced cross brace elements which are identified as 120, 122 with inboard section 36 and 124, 126 with outboard section 38. End elevational views of the cross brace elements 120, 122, 124, and 126 are shown in FIGS. 10A, 10B, 10C, and 10D of the drawings for structural rigidity each of the cross brace elements 120, 122, 124, and 126 have an L-shaped cross sectional configuration. Also, the outer free ends of the cross brace elements 120, 122, 124, and 126 are interconnected to one another through the interconnecting struts 130.

Each of the cross brace elements 120, 122, 124, and 126 are arranged to be structurally interconnected with the enclosed exterior wall constructions of the inboard section 36 and outboard section 38. More specifically, it will be seen in FIG. 9 that the interconnecting struts 130 of the cross brace elements 120, 122, associated with the inboard section 36, are arranged to engage elongated reinforcing members 132, 134 mounted to opposite inner side wall surfaces of side wall portions 90, 96 respectively. With regard to cross brace elements 124, 126, it will be seen in FIG. 9 that the interconnecting struts 130 of the cross brace elements 124, 126 directly engage opposite inner side surfaces of the opposite side wall portions 104, 106 of the enclosed exterior wall. Thus, twisting or bending is restrained or prevented by the aforementioned structural interconnection of components.

Figure 8:
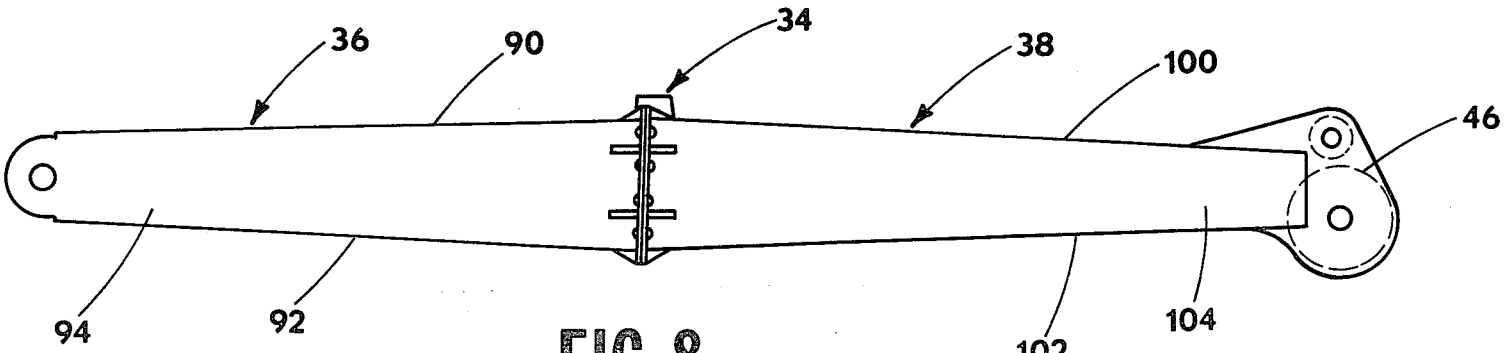
FIG. 8 is a side elevational view of the crane boom section shown in FIG. 7.

To further assist in restraining or preventing twisting or bending of the inboard section 36 and outboard section 38, it will be seen from FIG. 8 that both the upper and bottom wall portions 90, 92 of the inboard section 36 and 100, 102 of the outboard section 38 taper inwardly from the connected ends thereof to the opposite ends thereof. Also, the outboard section 38 has the opposite side wall portions 104, 106 tapering inwardly from the connected ends of the inboard and outboard sections 36, 38 to the opposite end thereof. As will be understood, the tapered configuration of the inboard and outboard sections 36, 38, together with the cross brace elements 120, 122, 124, and 126, restrain or limit twisting or bending of the crane boom sections.

The above described structure is disclosed and claimed in my U.S. Pat. No. 4,214,665 issued on July 29, 1980.

Stabilizing Outrigger Apparatus

While the front and rear stabilizing outrigger apparatus 53, 55 respectively are integrally supported by and weight distributed through the main bed frame 24, the specific designs are somewhat different, and therefore, it will be necessary to specifically describe both the front and rear stabilizing outrigger apparatus 53, 55 respectively.

Figure 11:
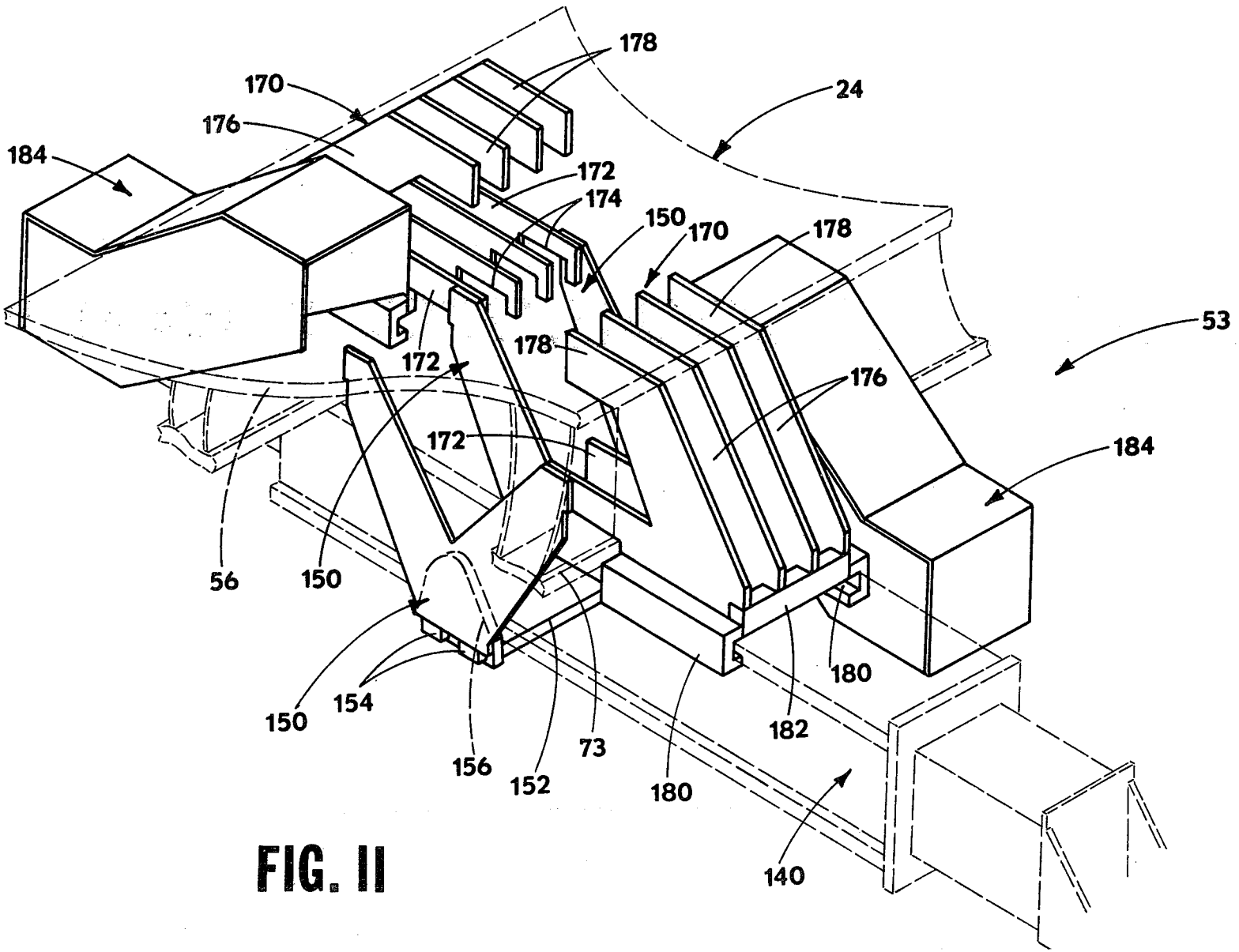
FIG. 11 is a fragmentary perspective view of the front stabilizing outrigger apparatus.

Referring first to the front stabilizing outrigger apparatus 53, it will be seen from FIG. 11 that the structural improvements of the front stabilizing apparatus 53 are shown in full lines while the main bed frame 24 and the extensible and retractable outrigger beams 140 are shown in dotted lines, in order to emphasize the inventive features of the front stabilizing apparatus 53.

The front stabilizing outrigger apparatus 53 includes oppositely directed outrigger beams in order to stabilize the vehicle from both sides; however, from the vantage point of FIG. 11, only one side is shown. Each outrigger beam 140 preferably is a multiple, telescoping section beam, as is known in the art, which is operated to effect transverse extension and retraction by hydraulic motors (not shown). At the free end of each outrigger beam 140, there is provided a vertically disposed hydraulic jack 142 which is connected to an outrigger foot 144 that engages the ground. This is best seen in FIG. 12 of the drawings where the outrigger beam 140, vertically disposed hydraulic jack 142 and the outrigger foot 144 are shown in full lines, in the retracted position, and also in dotted lines to show the horizontal extending movement of the outrigger beam 140 and the vertical movement of the hydraulic jack 142 to bring the outrigger foot 144 into engagement with the ground.

In order to distribute the load seen by the outrigger beams 140 through the ground engaging outrigger foot 144, the present invention has a unique outrigger beam suspension system and a unique load distribution design through the main bed frame 24, as will now be discussed.

Figure 12:
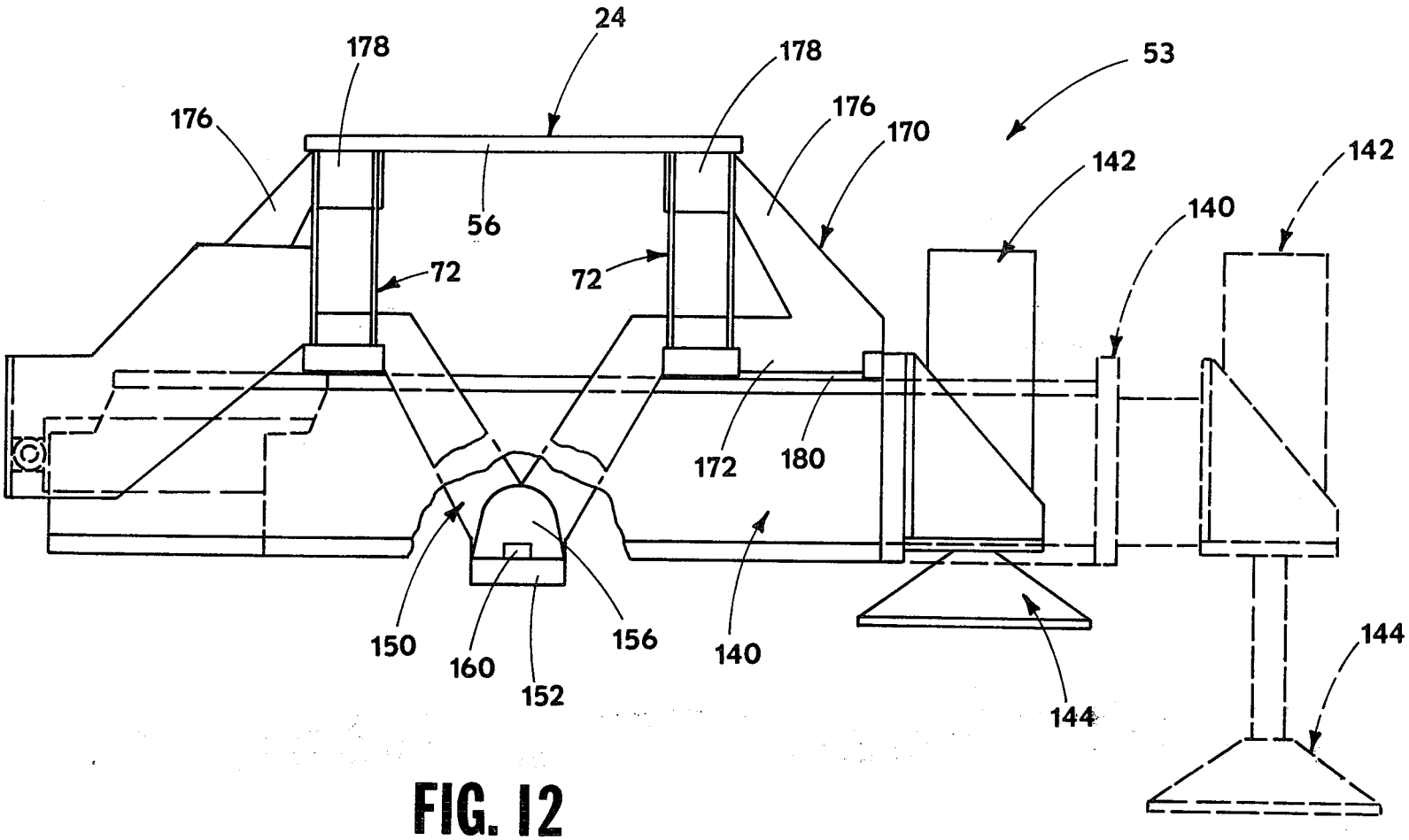
FIG. 12 is a fragmentary end elevational view of the front stabilizing outrigger apparatus.

As seen in FIGS. 11 and 12, the outrigger beam 140 which is shown as being suspended by the front outrigger supporting hangers 150, which are centrally disposed relative to the main bed frame 24. There are three front outrigger supporting hangers 150 used in order to support the oppositely directed outrigger beams 140 in the front stabilizing outrigger apparatus 53. Each front outrigger supporting hanger 150 has a V-shaped configuration which extends vertically downwardly from the main bed frame 24 and an elongated horizontal bearing support 152 which underlies the outrigger beams 140. The horizontal bearing support 152 has fingers 154 which extend through the bell-shaped member 156 which is, in turn, welded to the V-shaped front outrigger supporting hanger 150.

In order to equally load the V-shaped front outrigger supporting hanger 150, the horizontal bearing support 152 has an elongated horizontal bearing plate 160 which extends slightly above the horizontal bearing support 152. Thus, the outrigger beams 140 will apply, through the contact with the elongated horizontal bearing plate 160, equal bearing on the V-shaped front outrigger supporting hanger 150. As a result, neither side of the main bed frame 24 will see any more load than the other side.

For mounting the V-shaped front outrigger supporting hanger 150 to the main bed frame 24, it will be seen that the free ends thereof are welded to the front outrigger clevis 170 along the lower arm 172 thereof. The lower arm 172 of the front outrigger clevis 170 extends through the outer supporting frame sections 72, and includes a cutout portion 174 at the free end thereof which fits over the bottom bar 73 of the outer supporting frame sections 72, in order to undergird and support same.

The front outrigger clevis 170 also includes a sloping arm portion 176, which assists in supporting the outrigger beams 140 from the top side thereof, and a generally horizontal extending upper arm 178 which underlies and is welded to the under surface of the main frame bearing plate 56. It will also be noted that the generally horizontally extending upper arms 178 of the front outrigger clevis 170 also extend through the outer supporting frame sections 72 of the main bed frame 24, in the vicinity of the main frame bearing plate 56.

Thus, the front outrigger clevis 170 is welded to and supported by the outer supporting frame 72 against lateral movement, while the generally horizontally extending lower arm 172 is undergirded by the bottom bar 73 of the outer supporting frame section, and the generally horizontally extending upper arm 178 is welded to and supported by the main frame bearing plate 56.

For each outrigger beam 140, it will be noted that there are four front outrigger clevis members 170 which are mounted to the frame in the manner just described. Along the two outermost clevis members 170, there is provided a pair of opposed front outrigger slides 180 for guiding and supporting the outrigger beams 140 along the top thereof. A clevis connecting bar 182 is inserted in a cutout portion provided along the outermost juncture of the generally horizontally extending lower arm 172 and the sloping arm 176 of the front outrigger clevis members 170. As will be seen, the clevis connecting bar 182 also engages the opposed front outrigger slides 180.

It will be apparent that the clevis connecting bar 182, through the opposed front outrigger slides 180, distributes the load of the outrigger beam 140 through each front outrigger clevis 170.

The arrangement and design of the front stabilizing outrigger apparatus 53 is such as to place the sloping arms 176 of the front outrigger clevis members 170 in compression between the outrigger foot 144 and the main frame bearing plate 56. At the same time, the generally horizontally extending lower arm 172 of the front outrigger clevis members 170 is under tension in a direction opposite to the tension on the outrigger beam 140 in extended position. Thus, the opposed tension forces are designed to generally offset one another. As a result, the load on the outrigger beams is weight distributed through the main frame, so as to increase the load lifting capacity of the crane boom, without a proportionate increase in the weight thereof.

Front outrigger steps 184 are also shown in FIGS. 11 and 12 as being mounted adjacent to the front outrigger stabilizing apparatus 53 to facilitate mounting of the main bed frame 24 by the operator of the mobile vehicle.

Figure 13:
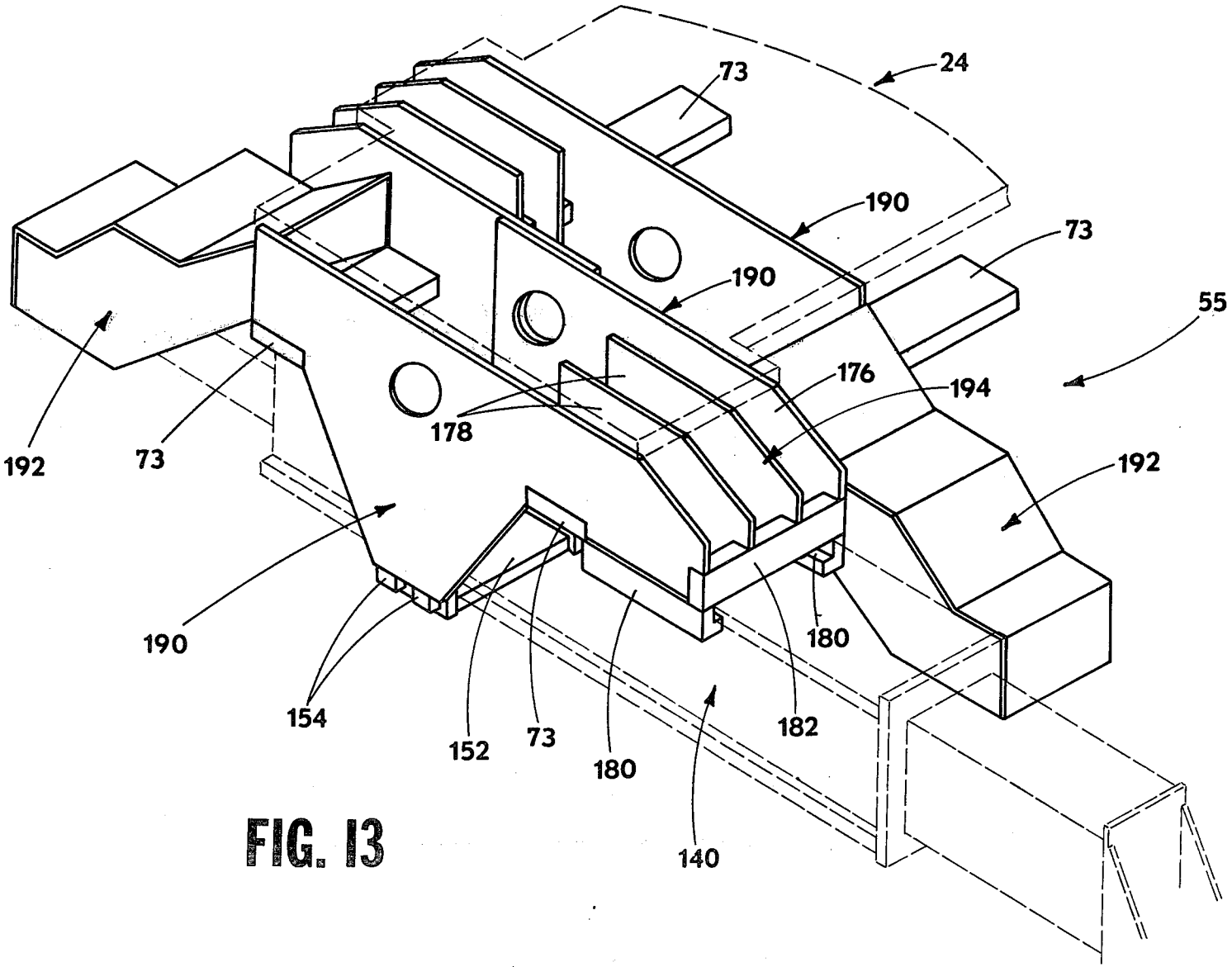
FIG. 13 is a fragmentary perspective view of the rear stabilizing outrigger apparatus.

Referring now to the rear stabilizing outrigger apparatus 55 shown in FIG. 13, like reference numerals will be used to designate those elements which are similar to the front stabilizing outrigger apparatus 53 shown in FIGS. 11 and 12. The basic difference between the front and rear stabilizing outrigger apparatus is that in the design of the latter, the rear outrigger hanger and clevis member 190 has been constructed as a single element to support the outrigger beams from both the bottom and top thereof. In the FIGS. 11–12 embodiment, the front outrigger stabilizing apparatus 53 included front outrigger supporting hangers 150 that were separate from the front outrigger clevis members 170.

In the FIG. 13 embodiment, there are three combined rear outrigger hanger and clevis members 190 which are spaced from each other, as shown. Intermediate adjacent combined rear outrigger hanger and clevis members 190 are rear outrigger steps 192 to aid the operator in mounting the main bed frame 24.

It will also be noted that there are two intermediate rear outrigger clevis members 194 which are mounted to the frame between adjacent combined rear outrigger hanger and clevis members 190, as shown. Thus, as in the FIGS. 11–12 embodiment, there are four outrigger clevis elements for supporting the outrigger beams 140 from the top thereof, through the rear outrigger slides 180, all of which are interconnected through the rear outrigger clevis connecting bar 182.

The holes shown in the combined rear outrigger hanger and clevis members 190 permit hydraulic lines (not shown) to be fed therethrough.

From the foregoing, it will be appreciated that the truck mounted railroad crane of the present invention has a unique structural design and interelationship that enables a substantial increase in the load lifting capacity without a corresponding increase in the weight of the vehicle. This is important since the present invention is the first truck mounted railroad crane with very large load lifting capacity (125 tons) at a given radius (11 ft.), enabling the crane to be operated off the side of the unit without damage to the frame thereof. Also, the design of the present invention meets most, if not all, highway load limit restrictions. All other prior art truck mounted railroad cranes with large lifting capacity cannot be operated off the side of the unit without damaging the frame, and they also do not meet highway load limit restrictions. Therefore, they must either be dismantled when moved or be in violation of the law. As can be seen, the truck mounted railroad of the present invention has greater load lifting capacity than all of the presently known large load lifting capacity units, and at the same time, fully meets most, if not all, highway load limit restrictions.

I claim:

1. In a mobile vehicle including a frame and a boom mounted on said frame, stabilizing outrigger apparatus comprising supporting hanger means centrally disposed relative to said frame and extending downwardly therefrom for mounting oppositely directed outrigger beams, equal bearing means associated with the supporting hanger means for directing equal forces through the supporting hanger means to the frame during extensible or retractable movement of the oppositely directed outrigger beams, outrigger beam guide means supported by and extending laterally outwardly from said frame, outrigger beam support means aldo extending laterally outwardly from said frame and including means for distributing through the frame the load encountered when the outrigger beams are in engagement with the ground, the frame including an upper main bearing plate upon which the boom is mounted and an inner supporting frame section separating a pair of outer supporting frame sections, all of which underlie and support the upper main bearing plate for substantially the entire length thereof, the pair of outer supporting frame sections each having a rectangular cross sectional configuration, and said outrigger beam support means at least partially undergirding and being attached to the upper main bearing plate while also at least partially extending through and being attached to one of the outer supporting frame sections on each side of said frame.

2. In the mobile vehicle as defined in claim 1 wherein the equal bearing means comprises an elongated horizontal bearing surface on said supporting hanger means which extends transversely relative to the outrigger beams.

3. In the mobile vehicle as defined in claim 1 wherein the outrigger beams guide means is integrally mounted relative to said outrigger beam support means.

4. In the mobile vehicle as defined in claim 1 wherein the outrigger beam support means includes means for placing at least part of same under compression for directing load forces into said frame.

5. In the mobile vehicle as defined in claim 4 wherein the outrigger beam support means also includes means for placing at least part of same under tension in a direction opposite to tension forces imparted through the extendible outrigger beams.

6. In the mobile vehicle as defined in claim 1 wherein the boom comprises two elongated boom sections, each boom section having an enclosed exterior wall with at least two spaced cross base elements extending substantially normal to the elongated construction of each boom section, each of sail cross brace elements contacting the inner surface of the enclosed exterior wall and supporting each boom section against twisting or bending thereof along the elongated construction thereof.

7. In the mobile vehicle as defined in claim 6 wherein the two elongated boom sections include an inboard section and an outboard section, said inboard and outboard sections being releasably interconnected to one another at one end of each boom section.

8. In the mobile vehicle as defined in claim 7 wherein each boom section has a rectangular cross sectional configuration defining upper, bottom and opposite side wall portions for the enclosed exterior wall, the upper and bottom wall portions of each boom section tapering toward each other from the interconnected ends of each boom section to the other ends thereof, and the opposite side wall portions of the outboard section of said crane boom assembly also tapering toward each other from the interconnected ends of each boom section to the other end thereof.

9. In the mobile vehicle as defined in claim 1 wherein there are spaced stabilizing outrigger apparatus mounted on said frame for supporting two pairs of oppositely directed outrigger beams.

* * * * *